US007941887B2

(12) United States Patent
Tsai

(10) Patent No.: US 7,941,887 B2
(45) Date of Patent: May 17, 2011

(54) MULTI-PURPOSE SHOWERHEAD

(76) Inventor: Ming-Yen Tsai, Taoyuan (TW)

( * ) Notice: Subject to any disclaimer, the term of this patent is extended or adjusted under 35 U.S.C. 154(b) by 874 days.

(21) Appl. No.: 11/976,219

(22) Filed: Oct. 23, 2007

(65) Prior Publication Data

US 2009/0101734 A1 Apr. 23, 2009

(51) Int. Cl.
*A47L 13/12* (2006.01)

(52) U.S. Cl. ..... 15/29; 15/52

(58) Field of Classification Search ..... 15/29, 28, 15/23, 24, 50.1, 50.2, 51, 52, 250.01–250.04; 239/399, 413, 46; 128/47, 50, 53, 58; 4/606, 4/615

See application file for complete search history.

(56) References Cited

U.S. PATENT DOCUMENTS 4,089,079 A * 5/1978 Nicholson ..... 15/29
4,155,137 A * 5/1979 Kadlub ..... 15/4
4,228,558 A * 10/1980 Zhadanov ..... 15/29
4,282,623 A * 8/1981 Gacuzana ..... 15/97.1
4,586,210 A * 5/1986 Mueller ..... 15/29
4,757,565 A * 7/1988 Sanchez ..... 15/29
4,763,373 A * 8/1988 Sanchez ..... 15/29
4,841,590 A * 6/1989 Terry et al. ..... 15/28
5,065,463 A * 11/1991 Le ..... 4/606
5,129,121 A * 7/1992 Gelman ..... 15/29
7,818,828 B2 * 10/2010 Zhou ..... 4/615

* cited by examiner

*Primary Examiner* — Dung Van Nguyen
(74) *Attorney, Agent, or Firm* — Rosenberg, Klein & Lee

(57) ABSTRACT

A multi-purpose showerhead includes a flexible conduit having a head end coupled to an water outlet of a faucet, a first water supply channel and a first water return channel being fitted within the flexible conduit, wherein the first water supply channel is connected to the water outlet of the faucet while the first water return channel is provided with a back flow opening extending outward near the head end; a showerhead main body having a shank member and a head member at the top of the shank member, the inside thereof being brought in a connected state. Meanwhile, a second, third, and fourth water supply channels as well as a second, third, and fourth water return channels are available. Moreover, return flow chambers and a blade wheel are disposed within the head member. In addition, a brush body and water-spraying perforations are fitted on the surface thereof. The adjustment knob permits the control of the switching of the water flow channels. In this way, the pressure of the water flowing into the showerhead may be employed to bring a brush body into autorotation for cleaning and massaging the body of the user without application of power to the showerhead. Meanwhile, the function of taking a shower or brushing the body or both functions can be chosen. Moreover, the water may flow back into the bathtub when the function of brushing the body is selected. Therefore, the water won't be wasted.

4 Claims, 7 Drawing Sheets

MULTI-PURPOSE SHOWERHEAD

BACKGROUND OF THE INVENTION

1. Field of the Invention

The invention relates to a multi-purpose showerhead, and more particularly to a multi-purpose showerhead that employs the pressure of the water flowing into the showerhead to bring a brush body into autorotation for cleaning and massaging the body of the user without application of power to the showerhead. Meanwhile, the function of taking a shower or brushing the body or both functions can be chosen. Moreover, the water may flow back into the bathtub when the function of brushing the body is selected. Therefore, the water won't be wasted.

2. Description of the Related Art

As shown in FIG. 1, a conventional showerhead 10 is connected by a flexible conduit 11 to a faucet 12 such that the water may flow through the flexible conduit 11 to the showerhead 10 and sprayed outward to clean the body of the user.

However, the conventional showerhead only permits the adjustment of the amount of the spraying water as well as the adjustment of spraying water in a water haze way or in a water jet way. In addition to these functions, the conventional showerhead can't achieve any other function.

Taking a bath requires water spraying on the body. In addition, the soap or the shower cream has to be applied to the body. Sometimes, the brush has to be used for washing and cleansing purposes.

Therefore, it is the main topic how to employ the pressure of the water flowing into the showerhead to bring a brush body into autorotation for cleaning the body of the user without application of power to the showerhead.

SUMMARY OF THE INVENTION

It is a primary object of the invention to provide a multi-purpose showerhead that employs the pressure of the water flowing into the showerhead to bring a brush body into autorotation for cleaning and massaging the body of the user without application of power to the showerhead. Meanwhile, the function of taking a shower or brushing the body or both functions can be chosen. Moreover, the water may flow back into the bathtub when the function of brushing the body is selected. Therefore, the water won't be wasted.

In order to achieve the above-mentioned object, a multi-purpose showerhead in accordance with the invention includes:

a) a flexible conduit having a head end coupled to an water outlet of a faucet, a first water supply channel and a first water return channel being fitted within the flexible conduit, wherein the first water supply channel is connected to the water outlet of the faucet while the first water return channel is provided with a back flow opening extending outward near the head end;

b) a showerhead main body having a shank member and a head member at the top of the shank member, the inside thereof being brought in a connected state, wherein the bottom of the shank member is attached to a tail end of the flexible conduit, and wherein a second water supply channel and a second water return channel are fitted within the shank member and communicated with the first water supply channel and the first water return channel, respectively, and wherein the head member includes a first return flow chamber that is connected to a third water supply channel and a third water return channel, and wherein a blade wheel is installed within the first return flow chamber, so that, when the water flows from the third water supply channel into the first return flow chamber and comes out from the third water return channel, the blade wheel will be rotated, and wherein a shaft of the blade wheel protrudes out of the first return flow chamber and brings a brush body on the surface of the head member into rotation, and wherein a second return flow chamber is disposed at the periphery of the first return flow chamber and connected to a fourth water supply channel, and wherein a plurality of perforations are formed at the surface thereof such that the water flowing into the second return flow chamber is sprayed out of the perforations; and c) an adjustment knob interposed between the shank member and the head member and having a rotation lug and a stopper, wherein the rotation lug for turning operation protrudes on the surface of the showerhead main body, and wherein the stopper for controlling the switching of the water flow channels is disposed within the showerhead main body, and wherein the stopper includes a plurality of connection channels at the side thereof for controlling the water supply channels and the water return channels in a connected (ON) or disconnected (OFF) state, whereby a plurality of options for taking a shower or brushing the body of the users are achieved by controlling the adjustment knob.

BRIEF DESCRIPTION OF THE FIGURES

The accomplishment of this and other objects of the invention will become apparent from the following descriptions and its accompanying figures of which:

FIG. 4A is a schematic drawing of an adjustment knob in accordance with FIG. 4;

FIG. 4B is a cutaway view taken along the line 4B-4B of FIG. 4A, showing the position of a rotation lug and a stopper;

FIG. 5A is a schematic drawing of an adjustment knob in accordance with FIG. 5;

FIG. 5B is a cutaway view taken along the line 5B-5B of FIG. 5A, showing the position of a rotation lug and a stopper;

FIG. 6A is a schematic drawing of an adjustment knob in accordance with FIG. 6;

FIG. 6B is a cutaway view taken along the line 6B-6B of FIG. 6A, showing the position of a rotation lug and a stopper.

DETAILED DESCRIPTION OF THE PREFERRED EMBODIMENT

Figure 1:
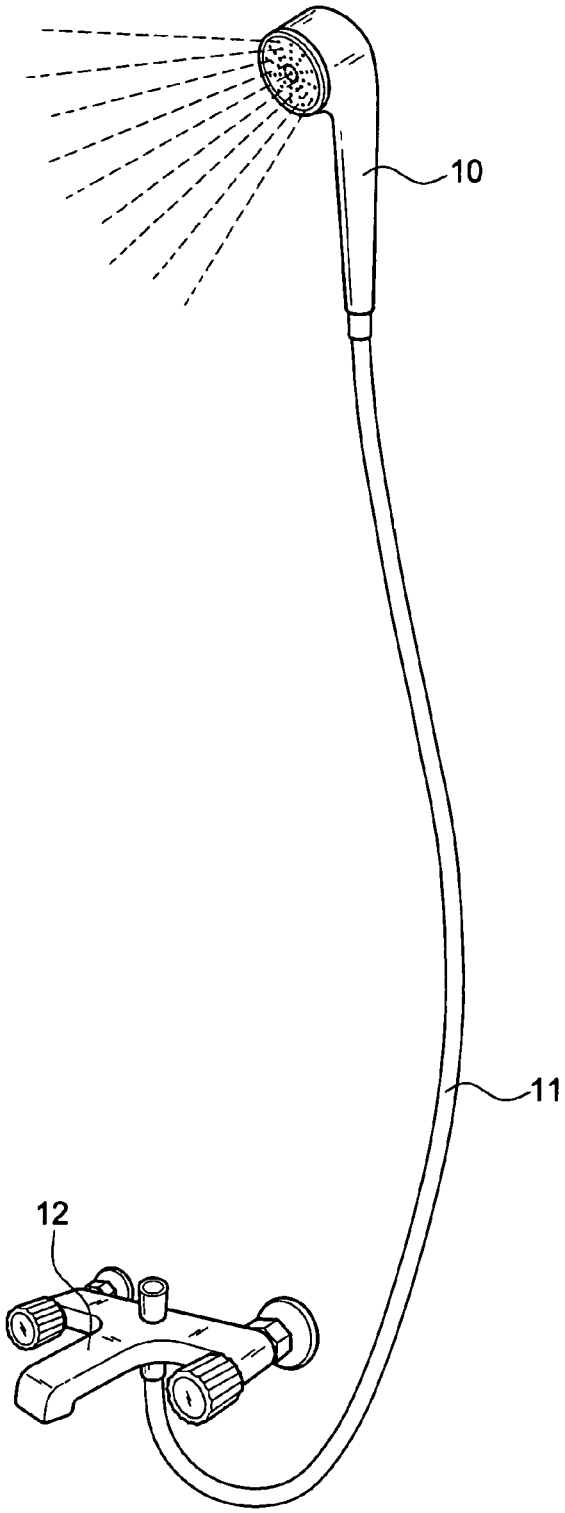
FIG.1 PRIOR ART
FIG. 1 is a perspective view of a conventional showerhead.
Figure 2:
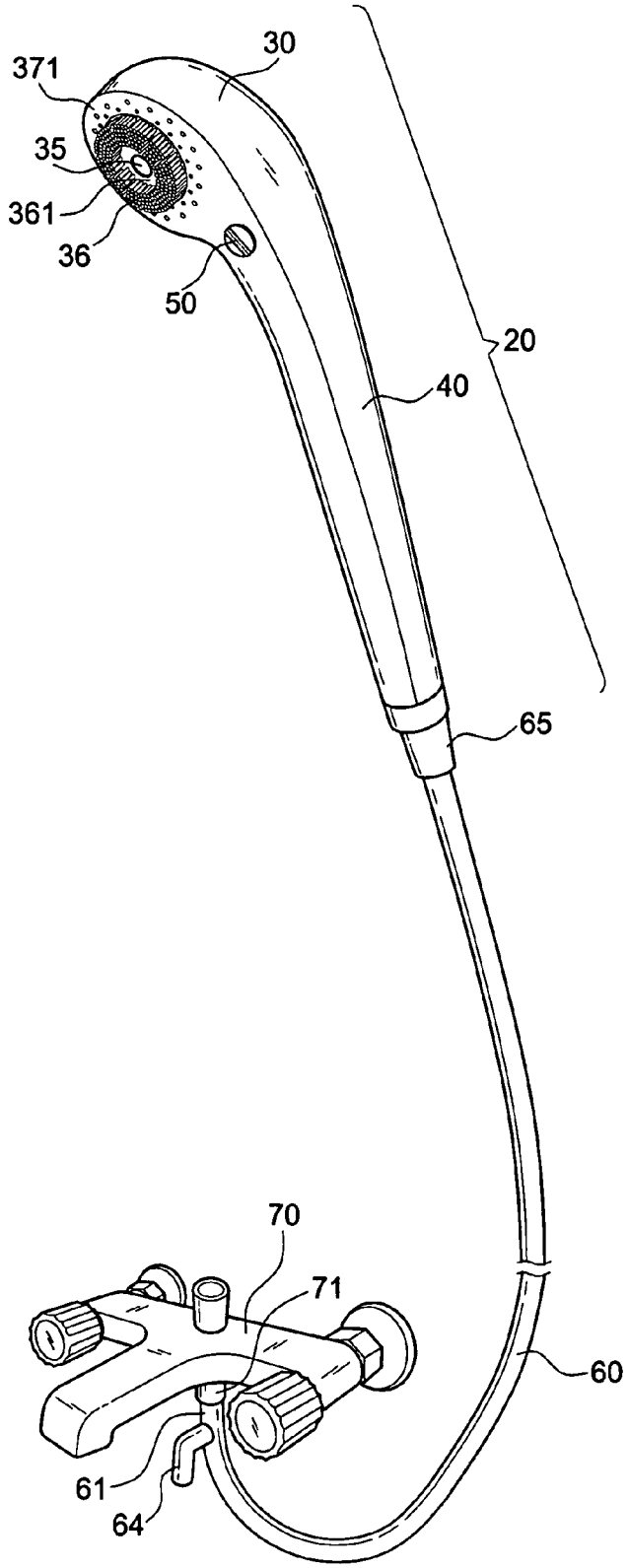
FIG. 2 is a perspective view of a preferred embodiment of the invention.
Figure 3:
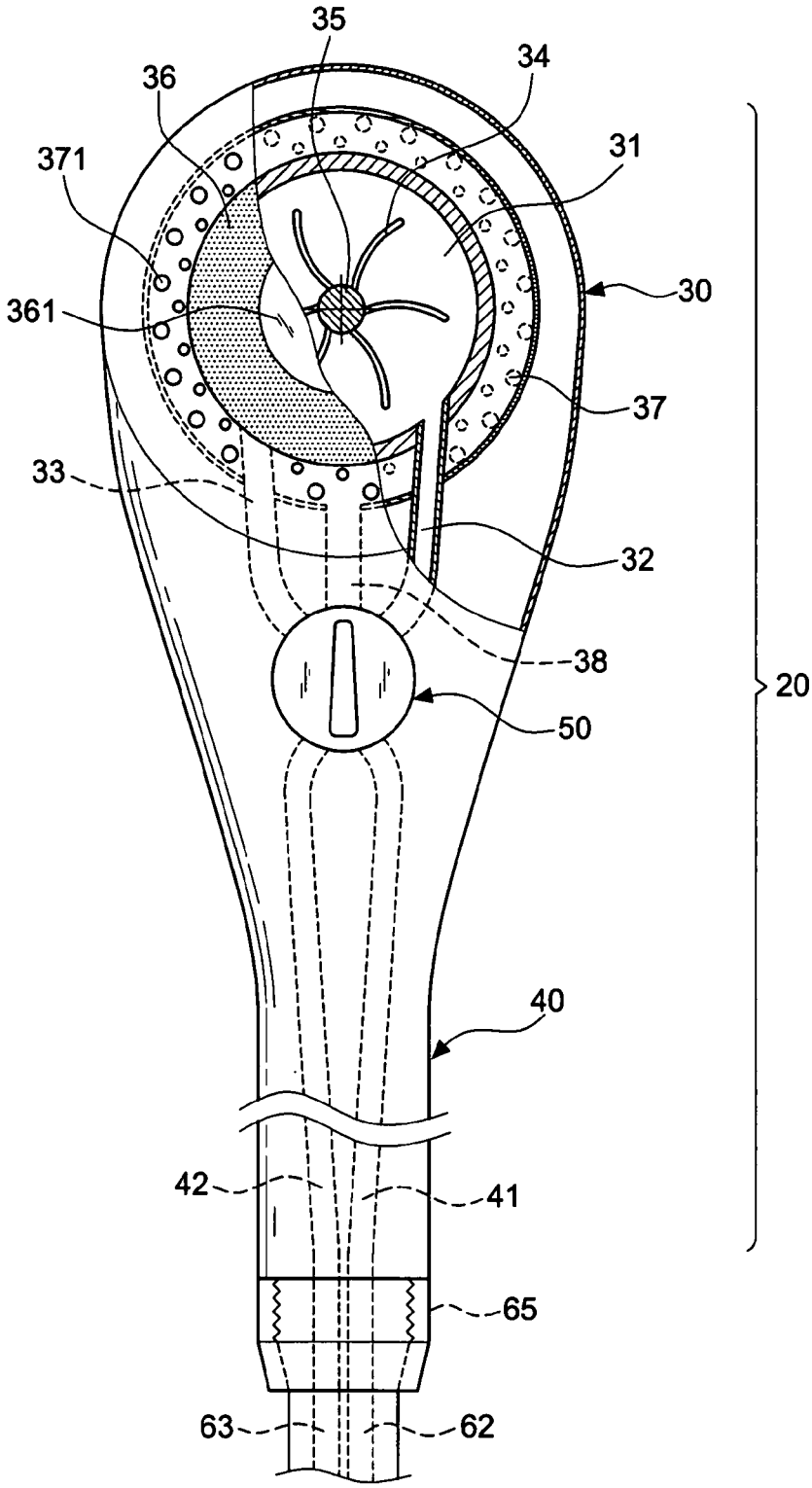
FIG. 3 is a schematic drawing of the structure of the showerhead main body in accordance with the preferred embodiment of the invention.
Figure 4:
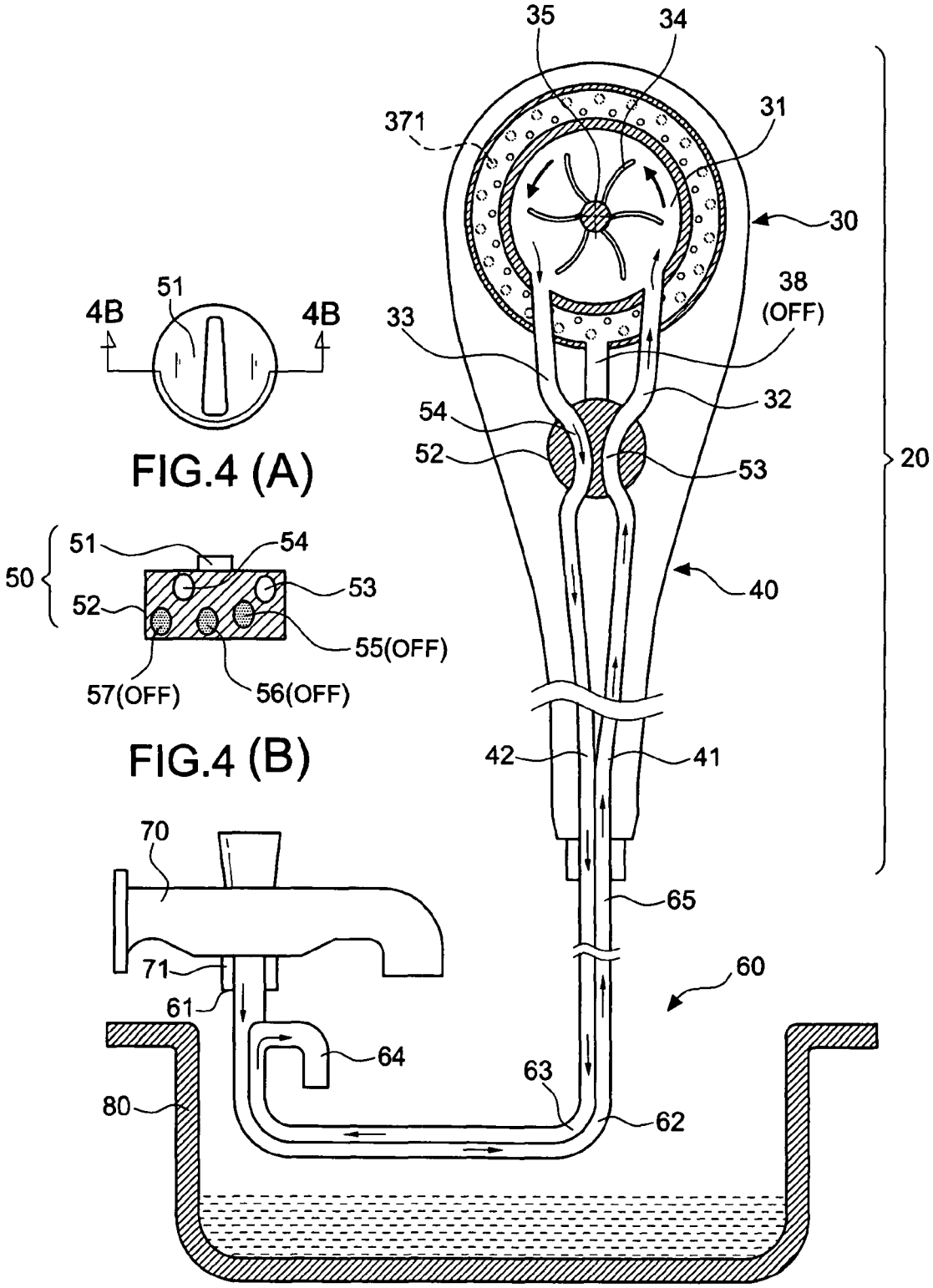
FIG. 4 is a schematic drawing of a first application state of the invention.

First of all, referring to FIGS. 2 through 4, a preferred embodiment of the invention includes a flexible conduit 60 and a showerhead main body 20.

The flexible conduit 60 has a head end 61 coupled to a water outlet 71 of a faucet 70. A first water supply channel 62 and a first water return channel 63 are fitted within the flexible conduit 60. The first water supply channel 62 is connected to the water outlet 71 of the faucet while the first water return channel 63 is provided with a back flow opening 64 extending outward near the head end 61.

The showerhead main body 20 includes a shank member 40 and a head member 30 at the top of the shank member 40.

The inside thereof is connected to each other. The bottom of the shank member 40 is attached to a tail end 65 of the flexible conduit 60. A second water supply channel 41 and a second water return channel 42 are fitted within the shank member 40 and communicated with the first water supply channel 62 and the first water return channel 63, respectively.

The head member 30 includes a first return flow chamber 31 that is connected to a third water supply channel 32 and a third water return channel 33. A blade wheel 34 is installed within the first return flow chamber 31. When the water flows from the third water supply channel 32 into the first return flow chamber 31 and comes out from the third water return channel 33, the blade wheel 34 will be rotated. Moreover, a shaft 35 of the blade wheel 34 protrudes out of the first return flow chamber 31 and brings a brush body 36 on the surface of the head member 30 into rotation. In other words, the brush body 36 is installed on a disc body 361. The bottom of the disc body 361 is attached to the shaft 35 of the blade wheel 34. A second return flow chamber 37 is disposed at the periphery of the first return flow chamber 31 and connected to a fourth water supply channel 38. A plurality of perforations 371 are formed at the surface thereof such that the water flowing into the second return flow chamber 37 is sprayed out of the perforations 371.

An adjustment knob 50 is interposed between the shank member 40 and the head member 30 and includes a rotation lug 51 and a stopper 52. As shown in FIG. 3, the rotation lug 51 for turning operation protrudes on the surface of the showerhead main body 20. As shown in FIGS. 4A and 4B, the stopper 52 for controlling the switching of the water flow channels is disposed within the showerhead main body 20. Meanwhile, the stopper 52 includes a plurality of connection channels 53~56 at the side thereof. The connection channel 53 and the connection channel 54 are adapted to bring the second water supply channel 41 and the third water supply channel 32 in connection to the second water return channel 42 and the third water return channel 33, respectively.

The above-mentioned adjustment knob 50 is used to control the switching of the water flow channels within the showerhead main body 20. In other words, it permits the adjustment control of the use functions. According to this embodiment, only one adjustment knob 50 is employed for controlling. Alternatively, two or three adjustment knobs 50 can be used to control the water supply channels and the water return channels, respectively. However, one adjustment knob 50 is preferable for the use. Therefore, the stopper 52 of the adjustment knob 50 must have several perforated connection channels. In the first application state, the brush body 36 is moved by the shaft 35 when the blade wheel 34 is rotated (see FIG. 4). As shown in FIGS. 4A and 4B, the rotation lug 51 is in an upright position. In addition, the first connection channel 53 of the stopper 52 is connected to the second and third water supply channels 41, 32 while the second connection channels 54 is connected to the second and third water return channel in an ON state. As shown in FIG. 4B, the third and fourth connection channels 55, 56 are brought in a disconnected state (OFF). The connection channels 53~56 are disposed in different position and height according to various requirements such that the adjustment knob 50 can control the required channel in an ON or OFF state when the adjustment knob 50 is turned to a predetermined position. According to the embodiment, the water coming from the faucet 70 flows through the water outlet 71 into the first water supply channel 62 of the flexible conduit 60. Thereafter, the water flows through the second water supply channel 41 of the shank member 40 into the first connection channel 53 of the stopper 52 and enters through the third water supply channel 32 into the first return flow chamber 31. By use of the water flow pressure, the blade wheel 34 will be rotated to bring the brush body 36 into autorotation. Moreover, the water flows from the third water return channel 33 via the second connection channels 54 and the second water return channel 42 into the first water return channel 63 and comes out of the back flow opening 64 into a bathtub 80. In this way, the water flow pressure may be employed for brushing the body of the operator by driving the brush body 36 to clean and massage the human body without any electric power supply. Meanwhile, the blade wheel 34 is driven to rotate the water to flow back to the bathtub 80 for further use.

Figure 5:
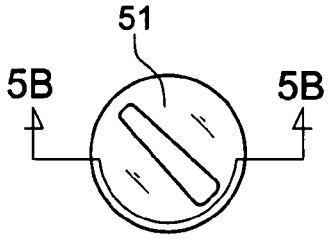
FIG. 5 is a schematic drawing of a second application state of the invention.
Figure 5:
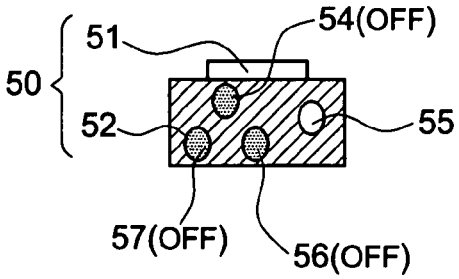
Figure 5:
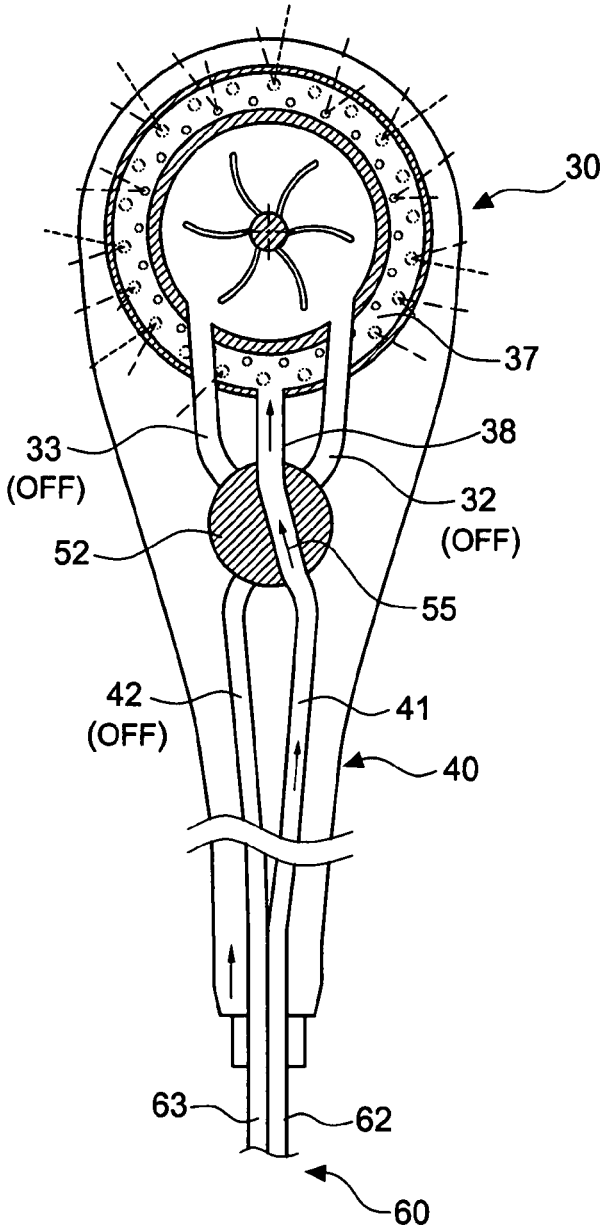

FIGS. 5, 5A, and 5B illustrate a second application state of the invention. According thereto, the rotation lug 51 of the adjustment knob 50 is turned left at a certain angle such that the third connection channel 55 is brought in connection to the second water supply channel 41 and the fourth water supply channel 38. In this way, the water flows into the second return flow chamber 37 and is sprayed out of the perforations 371 for the user to take a shower.

Figure 6:
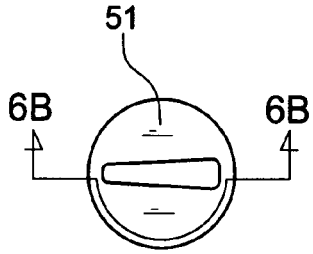
FIG. 6 is a schematic drawing of a second application state of the invention.
Figure 6:
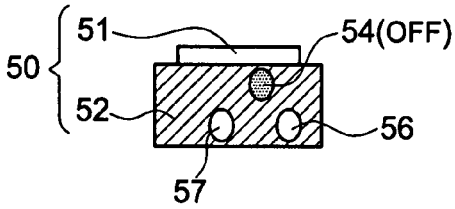
Figure 6:
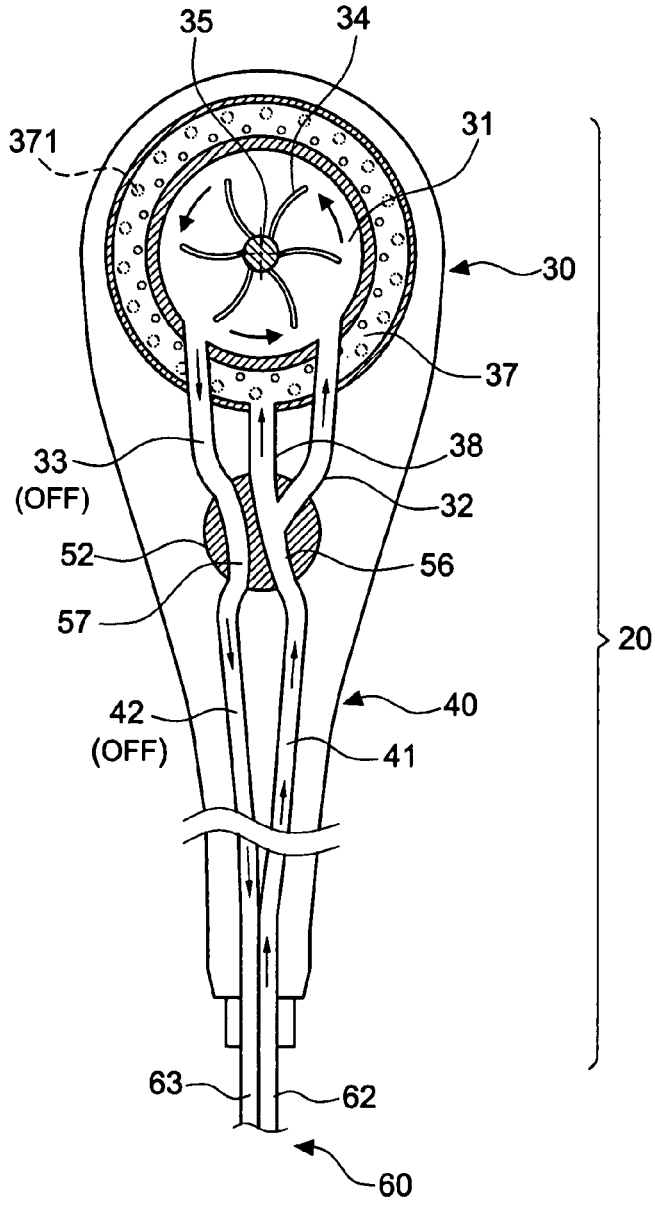

FIGS. 6, 6A, and 6B illustrate a third application state of the invention. According thereto, the rotation lug 51 of the adjustment knob 50 is turned into a substantially horizontal position such that the fourth connection channel 56 of the stopper 52 is brought in connection to the second, third, and fourth water supply channels 41, 43, 38. In this way, the fourth connection channel 56 is formed in a substantially Y-shaped fork. Accordingly, the water flows into the first return flow chamber 31 and the second return flow chamber 37. Meanwhile, the second and third water return channels 42, 33 are connected to each other by the fifth connection channel 57. In this case, the showerhead of the invention can be used both to brush the body and to take a shower, thereby fulfilling a double function.

Figure 7:
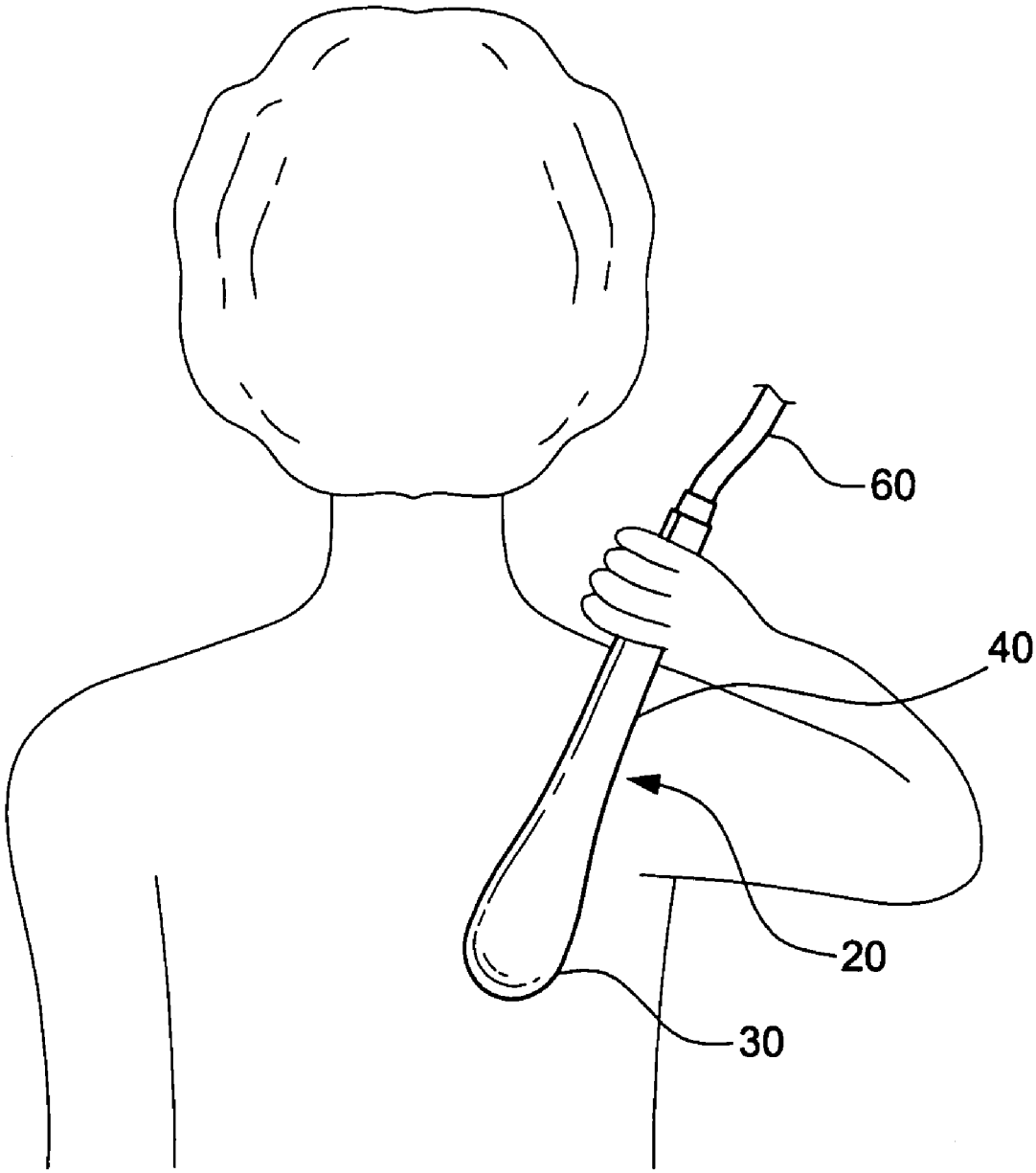
FIG. 7 is a schematic drawing of another application state of the invention.

FIG. 7 illustrates another application example of the invention. The shank member 40 of the showerhead in accordance with the invention is longer than the conventional one. As a result, the user can take it to brush his back. It is an extra function that the conventional showerhead can't fulfill.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A multi-purpose showerhead, comprising:

a) a flexible conduit having a head end coupled to an water outlet of a faucet, a first water supply channel and a first water return channel being fitted within the flexible conduit, wherein the first water supply channel is connected to the water outlet of the faucet while the first water return channel is provided with a back flow opening extending outward near the head end;

b) a showerhead main body having a shank member and a head member at the top of the shank member, the inside thereof being brought in a connected state, wherein the bottom of the shank member is attached to a tail end of the flexible conduit, and wherein a second water supply channel and a second water return channel are fitted within the shank member and communicated with the first water supply channel and the first water return channel, respectively, and wherein the head member includes a first return flow chamber that is connected to a third water supply channel and a third water return channel, and wherein a blade wheel is installed within the first return flow chamber, so that, when the water flows from the third water supply channel into the first return flow chamber and comes out from the third water return channel, the blade wheel will be rotated, and wherein a shaft of the blade wheel protrudes out of the first return flow chamber and brings a brush body on the surface of the head member into rotation, and wherein a second return flow chamber is disposed at the periphery of the first return flow chamber and connected to a fourth water supply channel, and wherein a plurality of perforations are formed at the surface thereof such that the water flowing into the second return flow chamber is sprayed out of the perforations; and c) an adjustment knob interposed between the shank member and the head member and having a rotation lug and a stopper, wherein the rotation lug for turning operation protrudes on the surface of the showerhead main body, and wherein the stopper for controlling the switching of the water flow channels is disposed within the showerhead main body, and wherein the stopper includes a plurality of connection channels at the side thereof for controlling the water supply channels and the water return channels in a connected (ON) or disconnected (OFF) state, whereby a plurality of options for taking a shower or brushing the body of the users are achieved by controlling the adjustment knob.

2. The multi-purpose showerhead as recited in claim 1 wherein the brush body is installed on a disc body, and wherein the bottom of the disc body is attached to the shaft of the blade wheel.

3. The multi-purpose showerhead as recited in claim 1 wherein the adjustment knob includes a first, second, third, fourth, and fifth connection channels that are disposed at different positions and directions on the stopper.

4. The multi-purpose showerhead as recited in claim 1 wherein the second and third water supply channels and the second and third water return channels are connected to each other by a first and second connection channels, respectively, and wherein the third connection channel brings the second and fourth water supply channels in connection to each other, and wherein the fourth connection channel brings the second water supply channel in connection both to the third water supply channel and to the fourth water supply channel, and wherein the second and third water return channels are connected to each other by the fifth connection channel.

* * * * *